US007803063B2

(12) United States Patent
Kumamoto

(10) Patent No.: US 7,803,063 B2
(45) Date of Patent: Sep. 28, 2010

(54) GOLF CLUB SHAFT

(75) Inventor: Tomio Kumamoto, Hyogo (JP)

(73) Assignee: SRI Sports Limited, Hyogo (JP)

( * ) Notice: Subject to any disclaimer, the term of this patent is extended or adjusted under 35 U.S.C. 154(b) by 0 days.

(21) Appl. No.: 12/219,419

(22) Filed: Jul. 22, 2008

(65) Prior Publication Data

US 2009/0029792 A1 Jan. 29, 2009

(30) Foreign Application Priority Data

Jul. 23, 2007 (JP) ..... 2007-190431

(51) Int. Cl.
*A63B 53/10* (2006.01)

(52) U.S. Cl. ..... 473/319

(58) Field of Classification Search ..... 473/319
See application file for complete search history.

(56) References Cited

U.S. PATENT DOCUMENTS 6,056,648 A * 5/2000 Kusumoto et al. ..... 473/319
6,364,787 B1 * 4/2002 Huiskamp ..... 473/294
6,905,422 B2 * 6/2005 Atsumi et al. ..... 473/319

FOREIGN PATENT DOCUMENTS

| | | | |
|---|---|---|---|
| JP | 3257238 B2 | | 10/1995 |
| JP | 8-131588 A | | 5/1996 |
| JP | 11155986 A | * | 6/1999 |
| JP | 2004-57673 A | | 2/2004 |

* cited by examiner

*Primary Examiner*—Stephen L. Blau
(74) *Attorney, Agent, or Firm*—Birch, Stewart, Kolasch & Birch, LLP

(57) ABSTRACT

A golf club shaft (10) having a weight not less than 30 g nor more than 60 g. The golf club shaft (10) includes a bias layer (B1) composed of a prepreg whose reinforcing fibers have an orientation angle of not less than ±10° nor more than 80° to an axis of the golf club shaft (10) and a straight layers (A1 through A6) each composed of a prepreg whose reinforcing fibers have an orientation angle within 0°±10° to the axis of the golf club shaft (10). At least one partial reinforcing hoop layer whose reinforcing fibers have an orientation angle of within 90°±10° to the axis of the golf club shaft (10) is disposed in only an important reinforcing region in a range from a point (P) spaced at 15% of a full length (L) of the golf club shaft (10) from a grip-side butt (12) thereof to a point (Q) spaced at 45% of the full length (L) of the golf club shaft (10) from the grip-side butt (12) thereof.

2 Claims, 9 Drawing Sheets

GOLF CLUB SHAFT

This nonprovisional application claims priority under 35 U.S.C. §119(a) on Patent Application No(s). 2007-190431 filed in Japan on Jul. 23, 2007, the entire contents of which are hereby incorporated by reference.

FIELD OF THE INVENTION

The present invention relates to a golf club shaft (hereinafter often referred to as merely shaft). More particularly, the present invention is intended to increase the head speed of a lightweight golf club shaft so that it has a high performance of hitting a golf ball a long distance.

DESCRIPTION OF THE RELATED ART

In recent years, to allow a golf club to hit a golf ball a long distance, the present tendency is to make the golf club shaft and the golf club head lightweight. Because there is the rule for restricting the flight performance of the golf club head, the golf club head has a limit in the design of enhancing the flight performance. Thus the shaft is demanded to have performance for hitting the golf ball a long distance.

To allow the shaft to hit the ball a long distance, it is important that the shaft returns favorably to its original state at a ball impact time when the player swings and that the head speed is increased. Thereby the shaft is capable of hitting the ball a long distance and has a stable directionality.

The present inventors have made researches on a stress applied to the shaft by using a swing simulation technique and found that when the shaft which has flexed during a swing does not return at a good timing at a ball impact time, a stress is applied to the grip side in a sectional direction thereof when the player swings to generate a crushing deformation at the grip side in the sectional direction thereof.

The present inventors have also found that because the outer diameter of the shaft becomes gradually larger and the thickness thereof becomes gradually thinner from the head side thereof to the grip side thereof, the crushing rigidity is low at the grip side and is thus subjected to a large stress. Consequently the sectional configuration of the shaft is liable to become elliptic.

Conventionally the material of the shaft is mainly steal. But the present tendency is to use fiber reinforced resin as a laminate of carbon prepregs or the like having a high specific strength and specific rigidity.

In a known technique, a bias layer, a straight layer, and a hoop layer are used in combination for the shaft made of the fiber reinforced resin to adjust a rigidity and a strength necessary for the shaft.

The reinforcing fibers of the bias layer are extended spirally with the reinforcing fibers inclining to the axial direction of the shaft. Thus the bias layer enhances a torsional rigidity and a torsional strength as its main function.

The reinforcing fibers of the straight layer are extended in parallel with the axial direction of the shaft. Thus the straight layer enhances a flexural rigidity and a flexural strength as its main function.

The reinforcing fibers of the hoop layer are extended in the circumferential direction of the shaft orthogonal to the axial direction thereof. Thus the hoop layer enhances a crushing rigidity and a crushing strength as its main function.

It is possible to produce golf club shafts having properties conforming to various purposes by designing the disposition of the bias layer, the straight layer, and the hoop layer each having the above-described function.

For example, in the cylindrical body disclosed in U.S. Pat. No. 3,257,238 (patent document 1), the innermost layer and the outermost layer are composed of the hoop layer, whereas the intermediate layer is composed of the straight layer. The modulus of elasticity in tension of the innermost layer composed of the hoop layer, that of the intermediate layer composed of the straight layer, and that of the outermost layer composed of the hoop layer are set to not less than 50 t/mm$^2$, not more than 60 t/mm$^2$, and not more than 50 t/mm$^2$ respectively. Description is made in the specification that this construction improves the flexural property and breaking strength of the shaft.

Because the cylindrical body disclosed in the patent document 1 does not have a bias layer, the cylindrical body has a low torsional rigidity and strength. Thus when the cylindrical body is used as a golf club shaft, it has an insufficient durability and a bad directional property. Further because in the patent document 1, the hoop layer is formed as the full-length layer, no technical ideas nor constructions which allow the property of the torsional rigidity improved by the hoop layer to serve for the improvement of the head speed are disclosed or suggested.

Because the reinforcing fibers of the hoop layer are disposed in the circumferential direction of the cylindrical body, the end of the hoop layer is liable to have a defective adhesion to an adjacent inner layer in a step of winding the prepreg forming the hoop layer. In addition, when the outermost layer is composed of the hoop layer, the cylindrical body is liable to have a poor outlook, and further a defective air accumulation is generated in a molded end product, which may lead to deterioration of durability.

In the golf club shaft disclosed in Japanese Patent Application Laid-Open No. 8-131588 (patent document 2), to enhance the torsional rigidity of the golf club shaft, the outermost layer, the intermediate layer, and the innermost layer are composed of the full-length bias layer, the full-length straight layer, and the full-length hoop layer respectively.

In the golf club shaft of the patent document 2, by disposing the full-length hoop layer inward from the full-length straight layer, the separation of the straight layer from the hoop layer is prevented when the shaft is bent. But this construction does not allow the improvement of the crushing rigidity of the hoop layer to serve for the improvement of the head speed.

As disclosed in Japanese Patent Application Laid-Open No. 2004-57673 (patent document 3), the present applicant proposed the golf club shaft having the partial hoop layer disposed at the grip-side butt to make the golf club shaft lightweight and yet keep the crushing strength at the grip-side butt.

But the grip-side butt of the shaft is held by player's hands. Therefore the grip-side butt little flexes during a swing. Thus even though the crushing rigidity at the grip-side butt is enhanced, the effect of improving the head speed cannot be expected. By disposing the partial hoop layer at the grip-side butt, it is possible to improve the crushing strength at the grip-side butt. But no technical ideas nor constructions allowing the property of the crushing rigidity improved by the hoop layer to serve for the improvement of the head speed are disclosed.

Patent document 1: Japanese Patent Application Laid-Open No. 3257238

Patent document 2: Japanese Patent Application Laid-Open No. 8-131588

Patent document 3: Japanese Patent Application Laid-Open No. 2004-57673

SUMMARY OF THE INVENTION

The present invention has been made in view of the above-described problems. Therefore it is an object of the present invention to provide a lightweight golf club shaft (hereinafter often referred to as merely shaft) capable of hitting a golf ball a long distance and improving the directional property thereof by allowing an improved crushing strength of a hoop layer to serve for the improvement of the head speed of the golf club shaft.

To achieve the object, the present invention provides a golf club shaft having a weight not less than 30 g nor more than 60 g. The golf club shaft includes a bias layer composed of a prepreg whose reinforcing fibers have an orientation angle of not less than +10° nor more than 80° to an axis of the golf club shaft; and a plurality of straight layers each composed of a prepreg whose reinforcing fibers have an orientation angle within 0°±10° to the axis of the golf club shaft. At least one partial reinforcing hoop layer whose reinforcing fibers have an orientation angle of within 90°±10° to the axis of the golf club shaft is disposed in only an important reinforcing region in a range from a point P spaced at 15% of a full length of the golf club shaft from a grip-side butt thereof to a point Q spaced at 45% of the full length of the golf club shaft from the grip-side butt thereof.

The present inventors have made swing simulation analysis and found that the portion to which a stress is applied at the time of a swing lies in a region (hereinafter referred to as "important reinforcing region X") between the above-described points P and Q. Based on the finding, they dispose a partial reinforcing hoop layer having a crushing rigidity inside the important reinforcing region X.

Before the shaft flexes, it is sectionally circular. When the shaft has flexed, it becomes sectionally elliptic. By disposing the partial reinforcing hoop layer in the important reinforcing region X, the crushing rigidity becomes large. As a result, the force of returning to a sectionally circular shape from a sectionally elliptic shape becomes large. As a result, the shaft returns to its original state from a flexed state. Consequently the head returns quickly at a ball impact time, and the head speed becomes fast. Thereby the flight distance of a hit ball increases and the directional property thereof can be improved.

On the other hand, the interval from the point P to the grip-side butt is a portion to be gripped by a player and little flexes during a swing because player's hands are disposed at the portion. Thus even though the crushing rigidity of the interval from the point P to the grip-side butt is enhanced, the speed-improving effect is low. The head side region with respect to the point Q is a region required to flex to some extent to increase the head speed. When a hoop layer is disposed in the head side region, the head side region flexes to a low extent, which causes the head speed to decrease.

Therefore it is necessary that the region where the partial reinforcing hoop layer is disposed does not exceed the important reinforcing region X. Considering that the shaft should be kept lightweight, the grip-side end of the region where the partial reinforcing hoop layer is disposed is spaced from the grip-side butt of the shaft at favorably 20% and more favorably 25% of the full length of the shaft. The head-side end of the region where the partial reinforcing hoop layer is disposed is spaced from the grip-side butt of the shaft at favorably 40% and more favorably 35% of the full length of the shaft.

The reason the weight of the shaft is set to not less than 30 g nor more than 60 g is because if the weight thereof is less than 30 g, the shaft has a low strength, whereas if the weight thereof is more than 60 g, the shaft is not lightweight and the thickness thereof is large. Therefore the crushing rigidity of the shaft is large, which makes it unnecessary to provide the shaft with the partial reinforcing hoop layer. The lower limit of the weight of the shaft is set to favorably not less than 32 g and more favorably not less than 34 g. The upper limit of the weight of the shaft is set to favorably not more than 58 g and more favorably not more than 56 g.

It is favorable that the modulus of elasticity in tension of the reinforcing fiber of the partial reinforcing hoop layer is set to 40 t/mm$^2$ nor more than 90 t/mm$^2$.

When the modulus of elasticity in tension of the reinforcing fiber thereof is less than 40 t/mm$^2$, the crushing rigidity is improved, but the degree of the improvement is low and the effect of increasing the head speed is low. On the other hand, when the modulus of elasticity in tension of the reinforcing fiber thereof is more than 90 t/mm$^2$, it is difficult to wind the hoop layer round the adjacent inner layer, and the hoop layer is defectively layered on the adjacent inner layer owing to peeling thereof from the adjacent inner layer. The modulus of elasticity in tension of the reinforcing fiber thereof is set to more favorably not less than 46 t/mm$^2$ and most favorably not less than 50 t/mm$^2$. The modulus of elasticity in tension of the reinforcing fiber thereof is set to more favorably not more than 85 t/mm$^2$ and most favorably not more than 80 t/mm$^2$.

As the reason the carbon fiber is used as the reinforcing fiber of the hoop layer, the carbon fiber has a small specific gravity and high modulus of elasticity and strength. As the reinforcing fiber of the hoop layer, it is possible to use fibers which are used as high-performance reinforcing fibers. For example, it is possible to use graphite fiber, aramid fiber, silicon carbide fiber, alumina fiber, boron fiber, glass fiber, and the like.

As the reinforcing fiber of the bias layer and the straight layer other than the hoop layer, other reinforcing fibers can be used in addition to the carbon fiber.

As the prepreg sheet whose partial reinforcing hoop layer contains preferable carbon fiber, "E6026A-07S", "E7026A-03S", "E7026B-05S", and "E8026A-07S" using fibers of "YSH-60", "YSH-70", "YS-80" produced by Graphite Fiber Co., Ltd. are listed. In addition, "P9053S-3", "P9053S-4", "P6053S-4", "P12056F-11", "P11255S-8", "P11255F-11", "P13056F-13", and "P14056F-13" using fibers of "M40S", "M46S", "M55J", "M50S", "M50J", "M60J", and "M65J" produced by Toray Industries, Inc. are listed.

Thermosetting resin and thermoplastic resin can be used for the prepreg forming the partial reinforcing hoop layer, the full-length bias layer, and the straight layer. In terms of strength and rigidity, the thermosetting resin is favorable and epoxy resin is especially favorable.

As the thermosetting resin, epoxy resin, unsaturated polyester resin, phenol resin, melamine resin, urea resin, diallyl phthalate resin, polyurethane resin, polyimide resin, and silicone resin are listed.

As the thermoplastic resin, polyamide resin, saturated polyester resin, polycarbonate resin, ABS resin, polyvinyl chloride resin, polyacetal resin, polystyrene resin, polyethylene resin, polyvinyl acetate resin, AS resin, methacrylate resin, polypropylene resin, and fluorine-containing resin are listed.

When the shaft has two or more partial reinforcing hoop layers, the weight of the shaft increases, which causes a decrease in the head speed. Therefore it is favorable to form not less than one layer nor more than two layers and more favorable to form one layer.

To enhance the durability of the shaft by improving the crushing rigidity and the crushing strength of the full length thereof, not less than one full-length hoop layer may be formed in addition to the partial reinforcing hoop layer. If too many full-length hoop layers are formed, the shaft has a large weight, which causes a decrease in the head speed. Therefore it is favorable to form not more than three full-length hoop layers and more favorable to form not more than two full-length hoop layers.

The thickness of the partial reinforcing hoop layer is set to favorably not less than 0.02 mm nor more than 0.10 mm. If the thickness of the partial reinforcing hoop layer is less than 0.02 mm, the partial reinforcing hoop layer is so thin that the fiber content ratio of the partial reinforcing hoop layer is low. Thus it is difficult to obtain a sufficient effect of increasing the head speed by improving the crushing rigidity. On the other hand, if the thickness of the partial reinforcing hoop layer is more than 0.10 mm, the configuration of both ends of the hoop layer in its longitudinal direction appears on the surface of the shaft after molded resin hardens, and a level difference or a thickness difference is generated on the surface of the shaft. As a result, the concentration of a stress is generated, and the shaft is liable to be broken and in addition is unpreferable in the outlook. The thickness of the partial reinforcing hoop layer is set to more favorably not less than 0.03 mm and most favorably not less than 0.04 mm. The thickness of the partial reinforcing hoop layer is set to more favorably not more than 0.09 mm and most favorably not more than 0.08 mm.

As described above, the reinforcing fibers are extended spirally with the reinforcing fibers inclining to the axial direction of the shaft. Thus the bias layer has properties of enhancing mainly the torsional rigidity and torsional strength of the shaft.

The number of the bias layers is set to favorably not less than two nor more than eight. If the number of the bias layers is less than two, the shaft is incapable of obtaining a sufficient effect for improving the torsional rigidity and torsional strength thereof. When the number of the bias layers is one, the torsional rigidity is unsymmetrical. If, the number of the bias layers is not less than eight, it is necessary to decrease the ratio of the straight layer and the hoop layer. As a result, the flexural rigidity, flexural strength, crushing rigidity, and crushing strength of the shaft become low. The number of the bias layers is set to favorably not more than six and more favorably not more than four.

The modulus of elasticity in tension of the reinforcing fiber of the bias layer is set to favorably not less than 24 t/mm$^2$ nor more than 55 t/mm$^2$.

If the modulus of elasticity in tension is less than 24 t/mm$^2$, the torque increases. As a result, the face of the golf club head slowly returns to its original state and the directional property of the ball is unfavorable at a ball impact time. On the other hand, if the modulus of elasticity in tension is more than 55 t/mm$^2$, the torsional strength of the shaft is low in a normal swing and the strength thereof is very low. The modulus of elasticity in tension of the reinforcing fiber of the bias layer is set to more favorably not less than 30 t/mm$^2$ and most favorably not less than 35 t/mm$^2$. The modulus of elasticity in tension of the reinforcing fiber of the bias layer is set to more favorably not more than 50 t/mm$^2$ and most favorably not more than 46 t/mm$^2$.

The thickness of the bias layer is set to favorably not less than 0.020 mm nor more than 0.150 mm.

If the thickness of the bias layer is set to less than 0.020 mm, the amount of resin of the prepreg is so small that the work of winding the bias layer round the core material cannot be easily performed, which causes the prepreg to have a defective adhesion. On the other hand, if the thickness of the bias layer is more than 0.150 mm, the bias layer is so thick that it is not easy to wind the bias layer along the core material, which causes the prepreg to wrinkle and so on. Thereby the shaft has a low strength. The thickness of the bias layer is set to more favorably not less than 0.030 mm and most favorably not less than 0.400 mm. The thickness of the bias layer is set to more favorably not more than 0.140 mm and most favorably not more than 0.130 mm.

As described above, because the reinforcing fibers of the straight layer extend in the axial direction of the shaft, the straight layer has the property of enhancing mainly the flexural rigidity and flexural strength of the shaft.

The number of the straight layers is set to favorably not less than one nor more than eight. If the number of the straight layers is set to less than one, the shaft is incapable of obtaining a sufficient effect of improving the flexural rigidity and the flexural strength and has a low torsional rigidity and a low torsional strength. On the other hand, if the number of the straight layers is set to more than eight, the number of prepregs is so large that the workability is low, and the material cost is high. The number of the straight layers is set to more favorably not less than two. The number of the straight layers is set to more favorably not more than six and most favorably not more than four.

The modulus of elasticity in tension of the reinforcing fiber of the straight layer is set to favorably 10 t/mm$^2$ nor more than 40 t/mm$^2$.

If the modulus of elasticity in tension of the reinforcing fiber of the straight layer is less than 10 t/mm$^2$, the shaft is so soft in the flexure direction thereof and low in the strength thereof that the three-point flexural strength thereof is low. On the other hand, if the modulus of elasticity in tension of the reinforcing fiber thereof is more than 40 t/mm$^2$, the flexural rigidity thereof is high, but the strength thereof is low. The modulus of elasticity in tension of the reinforcing fiber thereof is more favorably not less than 15 t/mm$^2$ and most favorably not less than 24 t/mm$^2$. The modulus of elasticity in tension of the reinforcing fiber thereof is more favorably not more than 35 t/mm$^2$ and most favorably not more than 30 t/mm$^2$.

The thickness of the straight layer is set to favorably not less than 0.020 mm nor more than 0.150 mm.

If the thickness of the straight layer is less than 0.020 mm, the amount of resin of the prepreg is so small that a work of winding the straight layer round the core material cannot be easily performed, which causes the straight layer to have defective adhesion to an adjacent layer and the shaft to have a low strength. On the other hand, if the thickness of the bias layer is more than 0.150 mm, the straight layer is so thick that it is not easy to perform the work of winding the straight layer along the core material, which causes the straight layer to wrinkle and so on and the shaft to have a low strength. In addition, the shaft is heavy, which causes a player to have difficulty in a swing. The thickness of the straight layer is set to more favorably not less than 0.030 mm and most favorably not less than 0.0400 mm. The thickness of the straight layer is set to more favorably not more than 0.140 mm and most favorably not more than 0.130 mm.

It is preferable that the full-length bias layer, the full-length straight layer, and the full-length hoop layer are disposed over the full length of the golf club shaft; the full-length straight layer is disposed as an outermost full-length layer; and the partial reinforcing hoop layer is disposed adjacently to the full-length straight layer with the partial reinforcing hoop layer disposed inward from an inner periphery of the full-length straight layer.

The length of the golf club shaft is set to favorably not less than 700 mm nor more than 1195 mm. If the length of the golf club shaft is less than 700 mm, a golf club is so short that it has a low performance in hitting the ball. If the length of the golf club shaft is more than 1195 mm, the golf club is so long that it is difficult for a player to swing. The length of the golf club shaft is set to more favorably not less than 750 mm and most favorably not less than 800 mm. The length of the golf club shaft is set to more favorably not more than 1181 mm and most favorably not more than 1168 mm.

The weight of the golf club shaft per unit length is set to favorably not less than 0.025 g/mm nor more than 0.050 g/mm. If the weight of the golf club shaft per unit length is less than 0.025 g/mm, the golf club shaft cannot be made from existing high-strength materials. Further in this case, even though the golf club shaft can be produced, it is impossible for the golf club shaft to have a strength high enough to withstand use. If the weight of the golf club shaft per unit length is more than 0.050 g/mm, the shaft is not kept lightweight. The weight of the golf club shaft per unit length is set to more favorably not less than 0.026 g/mm and most favorably not less than 0.027 g/mm. The weight of the golf club shaft per unit length is set to more favorably not more than 0.048 g/mm and most favorably not more than 0.045 g/mm.

The effect of the present invention is described below. The partial reinforcing hoop layer is disposed in the important reinforcing region X in the region from the point P spaced at 15% of the full length of the shaft from the grip-side butt thereof to the point Q spaced at 45% of the full length of the shaft from the grip-side butt thereof. Therefore it is possible to enhance the crushing rigidity of the important reinforcing region X which is most susceptible to a stress during a swing and consequently becomes sectionally deformable. Further it is possible to rapidly return the shaft to the original state thereof from a state thereof in which it has flexed at a swing time. That is, the shaft returns to the original state rapidly at the ball impact time, and thus the head speed can be effectively increased. Therefore it is possible to keep the weight of the shaft light and improve the flight distance and directional property of the hit ball.

DETAILED DESCRIPTION OF THE PREFERRED EMBODIMENTS

The embodiments of the present invention will be described below with reference to the drawings.

Figure 1:
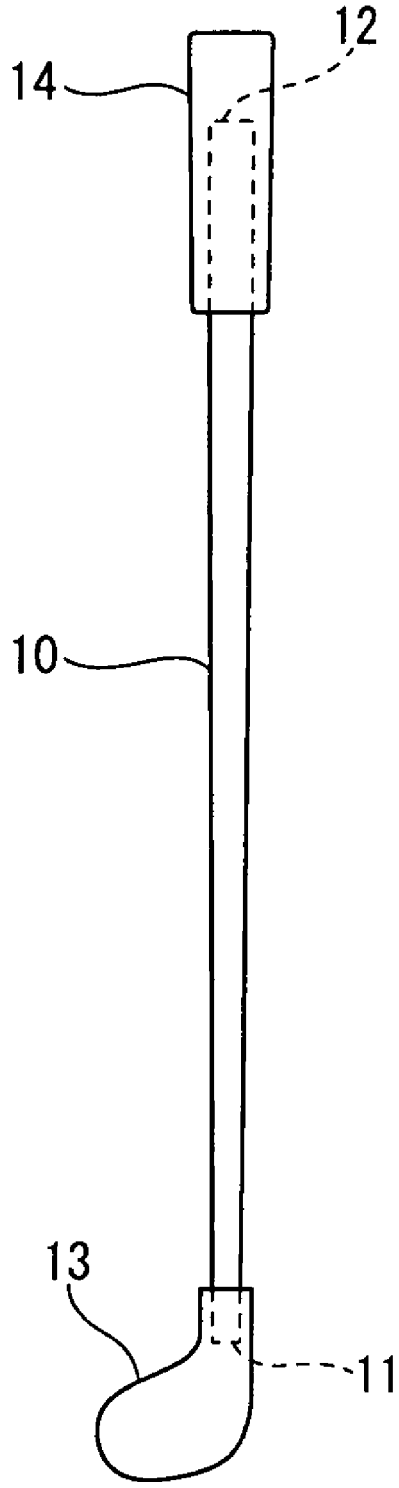
FIG. 1 is a schematic view showing a golf club of a first embodiment of the present invention.
Figure 2:
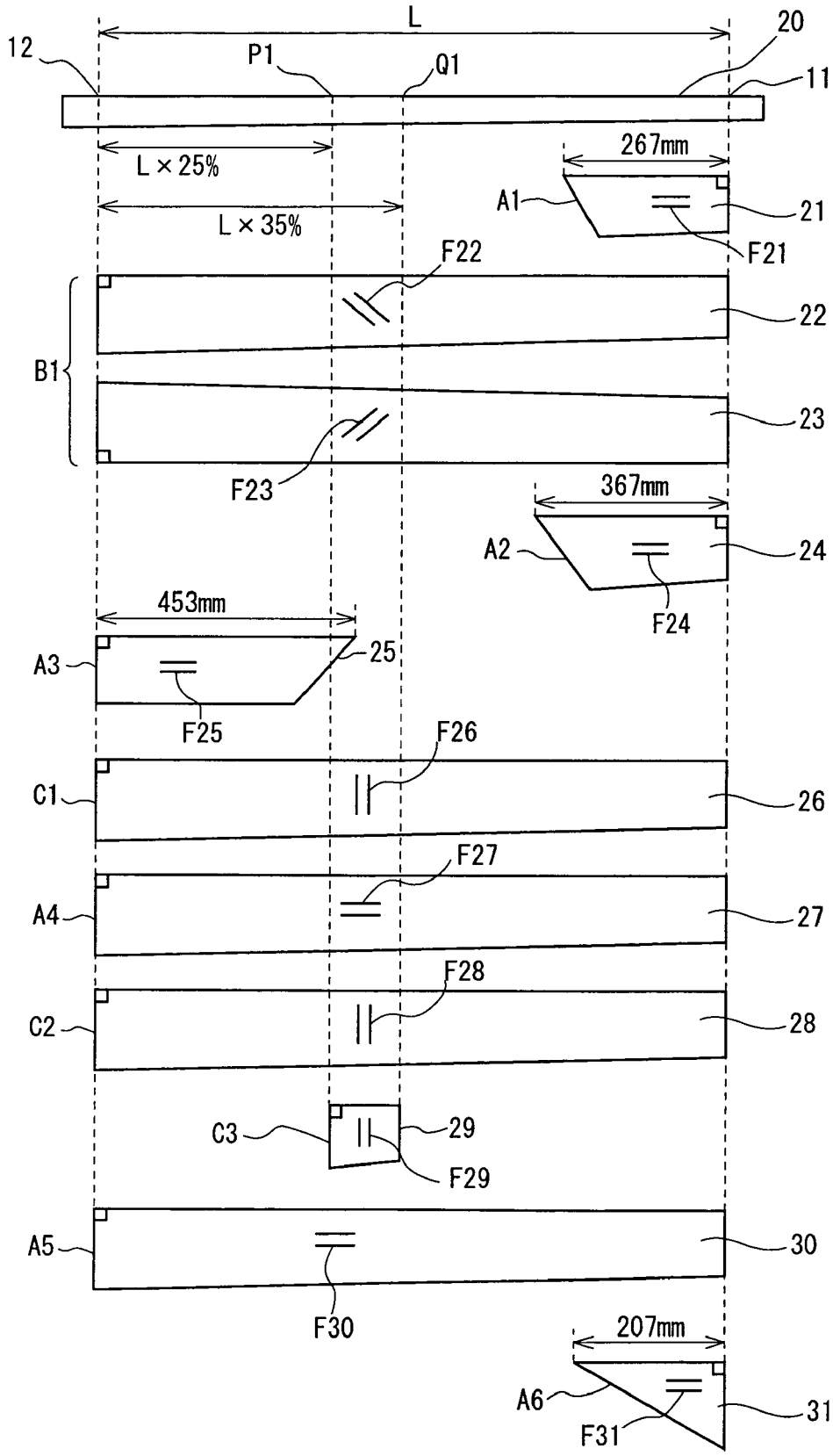
FIG. 2 shows a layered construction of fiber reinforced prepregs of the golf club shaft shown in FIG. 1.
Figure 3:
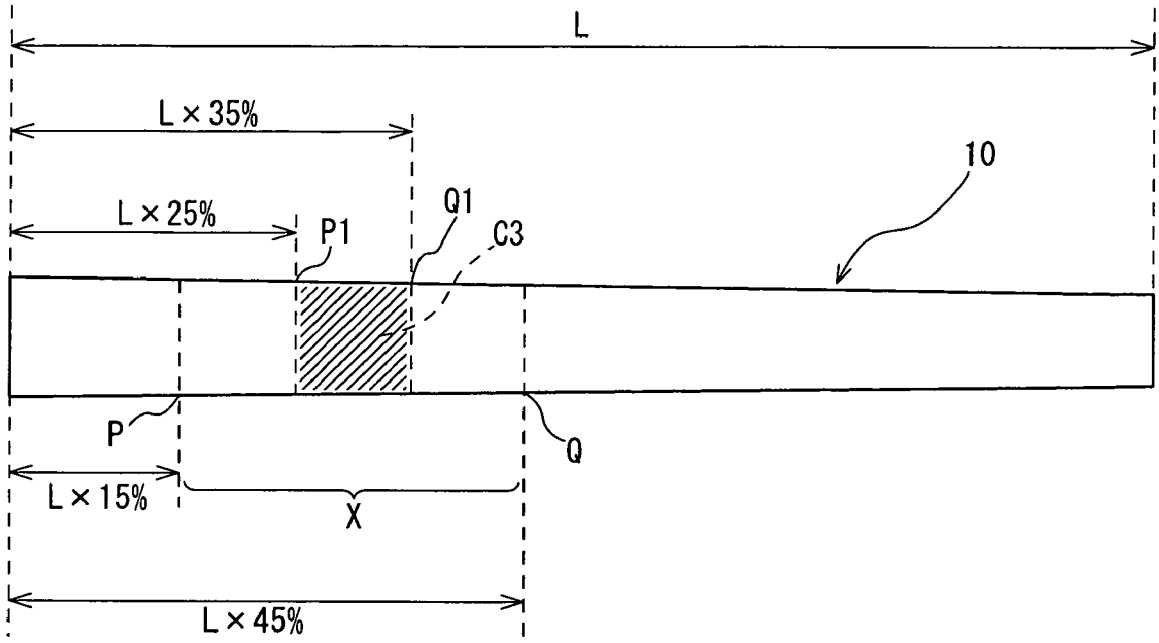
FIG. 3 is a plan view showing the golf club shaft shown in FIG. 1.

FIGS. 1 through 3 show a golf club shaft 10 (hereinafter often referred to as merely shaft 10) of a first embodiment of the present invention.

The shaft 10 is composed of a tapered long tubular body composed of a laminate of prepregs 21 through 31. A head 13 is mounted on a head-side tip 11 of the shaft 10 having the smallest diameter. A grip 14 is mounted on a grip-side butt 12 thereof having the largest diameter. The full length of the shaft 10 is set to 1158 mm. The weight of the shaft 10 is set to 46 g.

As shown in FIG. 2, in the shaft 10, a mandrel 20 is sequentially wound with one turn of the prepregs 21 through 31 in the order from the prepreg 21 to be disposed at the innermost side of the layered prepregs to the prepreg 31 to be disposed at the outermost side thereof by using a sheet winding method. Thereafter a tape made of polyethylene or polyethylene terephthalate is wound round the laminate of the prepregs 21 through 31 under pressure. After integral molding is performed by heating the laminate around which the tape has been wound in an oven under pressure to harden the resin, the mandrel 20 is drawn out of the laminate. In this manner, the shaft 10 is produced. After the surface of the shaft 10 is polished, both ends thereof are so cut that the full length L of the shaft 10 is 1158 mm. Thereafter the shaft 10 is painted.

The prepregs 21 through 31 constructing the shaft 10 are composed of epoxy resin and reinforcing fibers F21 through F31 consisting of carbon fibers impregnated therewith.

More specifically, the prepregs 22, 23, 26 through 28, and 30 are full-length layers to be disposed over the full length of the shaft 10, whereas the prepregs 21, 24, 25, 29, and 31 are partial layers to be partly disposed on the shaft 10 in the longitudinal direction thereof. The prepreg 29 is a partial reinforcing prepreg to be disposed in an important reinforcing region.

The prepreg 21 is disposed at the head-side tip of the shaft 10. The prepreg 21 has a length of 267 mm and a thickness of 0.0830 mm. The reinforcing fiber F21 thereof has a modulus of elasticity in tension of 24.5 t/mm$^2$ and forms an angle of 0° to the axis of the shaft 10. The prepreg 21 forms a partial reinforcing straight layer A1.

The prepregs 22 and 23 are disposed over the full length of the shaft 10 and have a thickness of 0.0570 mm respectively. The reinforcing fiber F22 thereof has a modulus of elasticity in tension of 40.0 t/mm$^2$ and forms an angle of −45° to the axis of the shaft 10. The reinforcing fiber F23 forms an angle of ±45° to the axis of the shaft 10. The two fiber reinforced prepregs 22 and 23 are wound round the mandrel 20 with the fiber reinforced prepregs 22 and 23 layered on each other and bonded to each other in such a way that the reinforcing fibers F22 and F23 thereof intersect with each other to form a full-length bias set layer B1.

The prepreg 24 is disposed at the head-side tip of the shaft 10. The prepreg 24 has a length of 367 mm and a thickness of 0.0850 mm. The reinforcing fiber F24 thereof has a modulus of elasticity in tension of 30.0 t/mm and forms an angle of 0° to the axis of the shaft 10. The prepreg 24 forms a partial reinforcing straight layer A2.

The prepreg 25 is disposed at the grip-side butt of the shaft 10. The prepreg 25 has a length of 453 mm and a thickness of 0.1057 mm. The reinforcing fiber F25 thereof has a modulus of elasticity in tension of 30.0 t/mm$^2$ and forms an angle of 0° to the axis of the shaft 10. The prepreg 25 forms a partial reinforcing straight layer A3.

The prepreg 26 is disposed over the full length of the shaft 10. The prepreg 26 has a thickness of 0.0341 mm. The reinforcing fiber F26 thereof has a modulus of elasticity in tension of 30.0 t/mm$^2$ and forms an angle of 90° to the axis of the shaft 10. The prepreg 26 F26 forms a full-length hoop layer C1.

The prepreg 27 is disposed over the full length of the shaft 10. The prepreg 27 has a thickness of 0.1057 mm. The reinforcing fiber F27 thereof has a modulus of elasticity in tension of 30.0 t/mm$^2$ and forms an angle of 0° to the axis of the shaft 10. The prepreg 27 forms a full-length straight layer A4.

The prepreg 28 is disposed over the full length of the shaft 10 and have a thickness of 0.0341 mm. The reinforcing fiber F28 thereof has a modulus of elasticity in tension of 30 t/mm$^2$ and forms an angle of 90° to the axis of the shaft 10. The prepreg 28 forms a full-length hoop layer C2.

The prepreg 29 forms a partial reinforcing hoop layer C3.

That is, the prepreg 29 has a length of 100 mm. The prepreg 29 is disposed in an important reinforcing region X in a range from a point P1 spaced at 25% of the full length L of the shaft 10 from the grip-side butt 12 thereof to a point Q1 spaced at 35% of the full length L of the shaft 10 from the grip-side butt 12 thereof. The prepreg has a thickness of 0.0400 mm. The reinforcing fiber F29 of the prepreg 29 has a modulus of elasticity in tension of 73.5 t/mm$^2$ and forms an angle of 90° to the axis of the shaft 10. The prepreg 29 forms the partial reinforcing hoop layer C3.

The prepreg 30 is disposed over the full length of the shaft 10. The prepreg 30 has a thickness of 0.1057 mm. The reinforcing fiber F30 thereof has a modulus of elasticity in tension of 30.0 t/mm$^2$ and forms an angle of 0° to the axis of the shaft 10. The prepreg 30 forms a full-length straight layer A5.

The prepreg 31 is disposed at the head-side tip of the shaft 10. The prepreg 31 has a length of 207 mm and a thickness of 0.0830 mm. The reinforcing fiber F31 thereof has a modulus of elasticity in tension of 24.5 t/mm$^2$ and forms an angle of 0° to the axis of the shaft 10. The prepreg 31 forms a partial reinforcing straight layer A6.

In the shaft 10 having the above-described construction, as shown in FIG. 3, the partial reinforcing hoop layer C3 is formed in the important reinforcing region X most susceptible to a stress during a swing, namely, in a region from a point P spaced at 15% (174 mm) of the full length L of the shaft 10 from the grip-side butt 12 thereof to a point Q (521 mm) spaced at 45% of the full length L of the shaft 10 from the grip-side butt 12 thereof. The partial reinforcing hoop layer C3 is disposed inward from the full-length straight layer A5 forming the outermost layer with the partial reinforcing hoop layer C3 adjacent to the inner side of the full-length straight layer A5. The partial reinforcing hoop layer C3 is disposed outward from the full-length hoop layer C2 with the partial reinforcing hoop layer C3 adjacent to the outer side of the full-length hoop layer C2. That is, the partial reinforcing hoop layer C3 is interposed between the full-length straight layer A5 and the full-length hoop layer C2.

As described above, the partial reinforcing hoop layer C3 is disposed in the important reinforcing region X in the region from the point P spaced at 15% of the full length L of the shaft 10 from the grip-side butt 12 thereof to the point Q spaced at 45% of the full length L of the shaft 10 from the grip-side butt 12 thereof. Therefore it is possible to enhance the crushing rigidity of the important reinforcing region X which is most susceptible to a stress during a swing and consequently becomes sectionally deformable. Therefore at a ball impact time, after the shaft 10 deforms from a sectionally circular configuration to sectionally elliptic configuration, a large force of returning the sectionally elliptic configuration to the original sectionally circular configuration acts, thus rapidly restoring the shaft 10 to the original state from the state thereof in which it has flexed at the swing time. That is, the shaft 10 returns to the original state rapidly at the ball impact time. Therefore the head speed can be effectively increased. Therefore it is possible to keep the weight of the shaft 10 light and improve the flight distance and directional property of the hit ball.

The disposed region of the partial reinforcing hoop layer C3 does not exceed the important reinforcing region X at the grip side and the head side. Therefore it is possible to restrain a weight increase and secure a proper degree of flexure of the shaft which is necessary for increasing the flight distance of a ball.

The reinforcing fiber of the prepreg 29 forming the partial reinforcing hoop layer C3 has the modulus of elasticity in tension of 73.5 t/mm$^2$ which is not less than 40 t/mm$^2$ nor more than 90 t/mm$^2$. The prepreg 29 forms the. Therefore the prepreg 29 has a high elasticity and is thus capable of displaying the effect of improving the head speed. Further it is easy to wind the prepreg 29 and possible to prevent it from being layered on the inner layer in a defective adhesion thereto.

EXAMPLES

Golf club shafts of examples 1 through 6 of the present invention and comparison examples 1 through 5 are described in detail below.

As shown in table 1 shown below, the shafts of the examples 1 through 6 were formed by differentiating each of fiber moduli of elasticity in tension, thicknesses, fiber orientation angles, and layering regions of the ninth-layer prepreg of the shaft of the first embodiment from each other, namely, by differentiating each of the fiber moduli of elasticity in tension, the thicknesses, the fiber orientation angles, and the layering regions of the prepregs of the shafts of the examples 1 through 6 each disposed between the full-length hoop layer C2 forming the eighth layer and the full-length straight layer A5 forming the tenth layer from each other.

TABLE 1

| | | Example 1 | Example 2 | Example 3 | Example 4 | Example 5 | Example 6 | Comparison Example 1 | Comparison Example 2 | Comparison Example 3 | Comparison Example 4 | Comparison Example 5 |
|---|---|---|---|---|---|---|---|---|---|---|---|---|
| Weight (g) of shaft | | 46 | 47 | 46 | 46 | 54 | 46 | 46 | 52 | 43 | 46 | 48 |
| Ninth-layer sheet | Name of prepreg | E7026A-03S | E8026A-07S | E7026A-03S | P6053S-3 | NU71500-525S | MR350J-050S | E7026A-03S | E7026A-03S | | E7026A-03S | E7026A-03S |
| | Maker | Nippon Graphite Fiber Corp | Nippon Graphite Fiber Corp | Nippon Graphite Fiber Corp | Toray Industries, Inc. | Nippon Graphite Fiber Corp | Mitsubishi Rayon Co., Ltd. | Nippon Graphite Fiber Corp | Nippon Graphite Fiber Corp | | Nippon Graphite Fiber Corp | Nippon Graphite Fiber Corp |

TABLE 1-continued

| | Example 1 | Example 2 | Example 3 | Example 4 | Example 5 | Example 6 | Comparison Example 1 | Comparison Example 2 | Comparison Example 3 | Comparison Example 4 | Comparison Example 5 |
|---|---|---|---|---|---|---|---|---|---|---|---|
| Modulus of elasticity in tension ($t/mm^2$) | 73.5 $t/mm^2$ | 80.1 $t/mm^2$ | 70 $t/mm^2$ | 44.5 $t/mm^2$ | 73.5 $t/mm^2$ | 30 $t/mm^2$ | 70 $t/mm^2$ | 70 $t/mm^2$ | | 70 $t/mm^2$ | 70 $t/mm^2$ |
| Thickness | 0.04 mm | 0.07 mm | 0.04 mm | 0.0227 mm | 0.11 mm | 0.058 mm | 0.04 mm | 0.04 mm | | 0.04 mm | 0.04 mm |
| Fiber orientation angle | 90° | 90° | 90° | 90° | 90° | 90° | 90° | ±45° | | 90° | 90° |
| Insertion position (position from grip-side butt) | 25~35% | 25~35% | 25~30% | 25~35% | 25~35% | 25~35% | Full length of shaft | 25~35% | | 0~10% | 90~100% |
| | | | | | | | | | Unprovided with ninth-layer sheet | | |
| Head speed in ball-hitting test | 46 m/s | 47 m/s | 45 m/s | 45 m/s | 43 m/s | 43 m/s | 41 m/s | 41 m/s | 40 | 40 | 41 |
| Flight distance (yard) | 220 | 225 | 215 | 215 | 205 | 205 | 190 | 190 | 185 | 192 | 190 |

By using the sheet winding method, the shafts of the examples 1 through 6 and the comparison examples 1 through 5 were produced in the same method as that of the first embodiment.

The prepregs of the examples 1 through 6 and the comparison examples 1 through 5 shown in table 1 are prepregs each forming the partial reinforcing hoop layer C3 (ninth layer) of the first embodiment disposed between the full-length hoop layer C2 forming the eighth layer and the full-length straight layer A5 forming the tenth layer. Other prepreg-layering constructions were identical to that of the first embodiment.

In each of the examples 1 through 6 and the comparison examples 1 through 5, the full length L of the shaft was equally set to 1158 mm. The weight of the shaft of each of examples and the comparison examples and the specification of the partial reinforcing hoop layer C3 were set, as shown in table 1. The same material described below was used for the layers of the shafts of the examples and the comparison examples other than the partial reinforcing hoop layer C3.

The innermost layer (first layer) was formed as a head-side partial reinforcing straight layer A1 by using a product "TR350C-100S" (carbon fiber reference number: "TR50") produced by Mitsubishi Rayon Co., Ltd. The second and third layers were formed as a full-length bias set layer B1 by using a product "HRX350C-075S" (carbon fiber reference number: "HR40") produced by Mitsubishi Rayon Co., Ltd.

The fourth layer was formed as a head-side partial reinforcing straight layer A2 by using a product "MR350C-100S" (carbon fiber reference number: "MR40") produced by Mitsubishi Rayon Co., Ltd.

The fifth layer was formed as a grip-side partial reinforcing straight layer A3 by using a product "P8255S-10" (carbon fiber reference number: "M30S") produced by Toray Industries, Inc.

The sixth layer was formed as a full-length hoop layer C1 by using a product "P805S-3" (carbon fiber reference number: "M30S") produced by Toray Industries, Inc.

The seventh layer was formed as a full-length straight layer A4 by using a product "P8255S-10" (carbon fiber reference number: "M30S") produced by Toray Industries, Inc.

The eighth layer was formed as a full-length hoop layer C2 by using a product "P805S-3" (carbon fiber reference number: "M30S") produced by Toray Industries, Inc.

The tenth layer was formed as a full-length straight layer A5 by using a product "P8255S-10" (carbon fiber reference number: "M30S") produced by Toray Industries, Inc.

The eleventh layer was formed as a head-side partial reinforcing straight layer A6 by using a product "TR350C-100S" (carbon fiber reference number: "TR50") produced by Mitsubishi Rayon Co., Ltd.

In the shafts of the examples 1 through 6 and the comparison examples 1 through 5, the detail of the partial reinforcing hoop layers C3 each disposed at the ninth layer from the innermost layer is as described below.

Example 1

A prepreg having a fiber orientation angle of 90° was wound in a range from a point P1 spaced at 25% of the full length L of the shaft 10 from the grip-side butt 12 thereof to a point Q1 spaced at 35% of the full length L of the shaft 10 from the grip-side butt 12 thereof to form a partial reinforcing hoop layer C3. The ninth-layer prepreg composed of a product produced by Graphite Fiber Co., Ltd. had a fiber modulus of elasticity in tension of 73.5 $t/mm^2$ and a thickness of 0.04 mm. The prepreg had a reference number of "E7026A-03S" (carbon fiber reference number: "YSH-70").

Example 2

The shaft of the example 2 was the same as that of the example 1 in that the ninth-layer prepreg from the innermost layer was composed of the partial reinforcing hoop layer C3, having a fiber orientation angle of 90°, which was disposed in the region from the point P1 to the point Q1. But the shaft of the example 2 was different from that of the example 1 in that the ninth-layer prepreg produced by Graphite Fiber Co., Ltd. had a modulus of elasticity in tension of 80.1 t/mm and a thickness of 0.07 mm. The prepreg had a reference number of "E8026A-07S" (carbon fiber reference number: "YS-80").

Example 3

Figure 4:
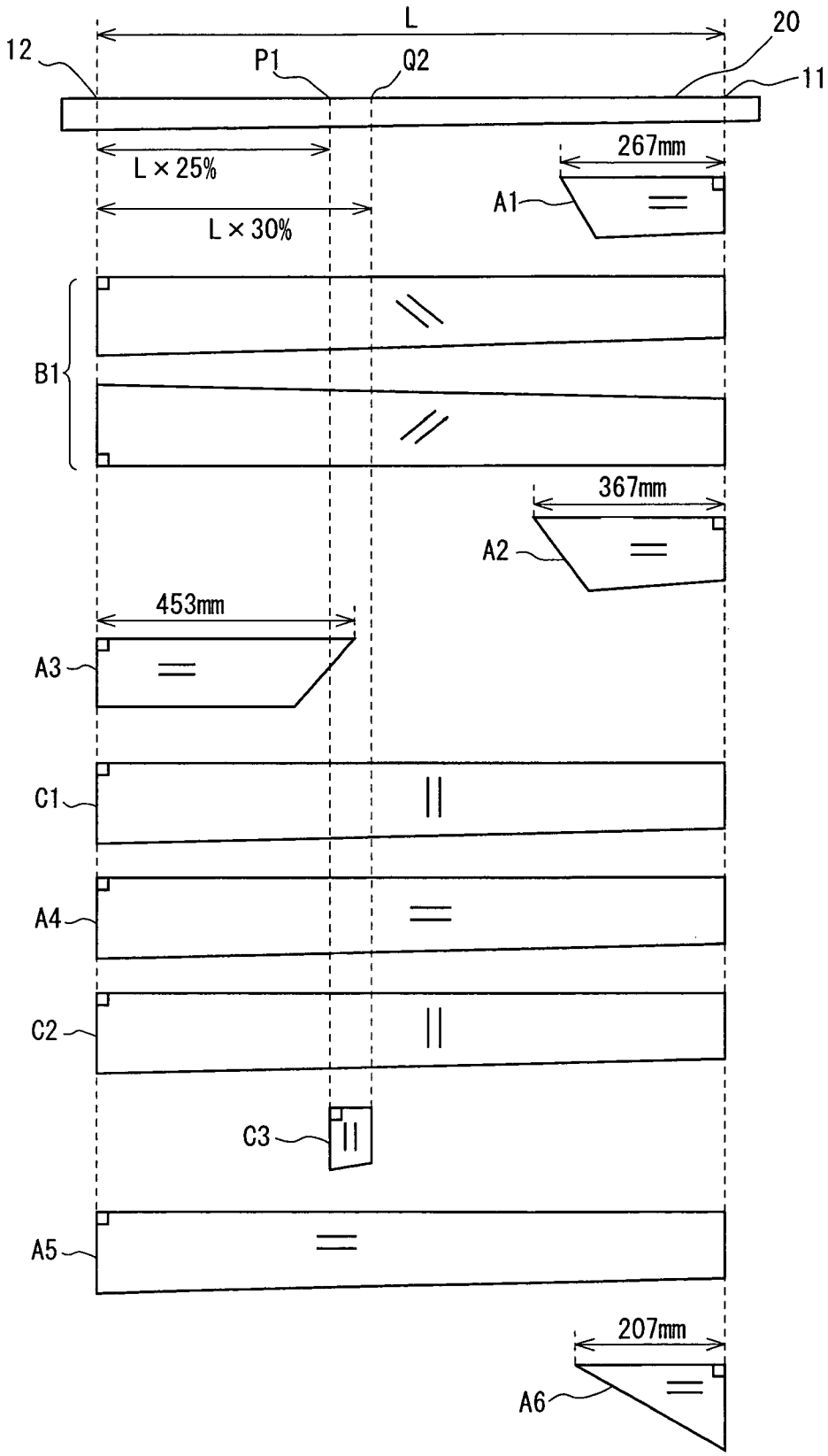
FIG. 4 shows a layered construction of fiber reinforced prepregs of a golf club shaft of a third example.

As shown in FIG. 4, the shaft of the example was the same as that of the example 1 except that as shown in FIG. 4, the region where the partial reinforcing hoop layer C3 was disposed was in the range from a point P1 spaced at 25% of the full length L of the shaft 10 from the grip-side butt 12 thereof to a point Q2 spaced at 30% of the full length L of the shaft 10 from the grip-side butt 12 thereof.

Example 4

The shaft of the example 4 was the same as that of the example 1 in that the ninth-layer prepreg from the innermost layer was composed of the partial reinforcing hoop layer C3 having a fiber orientation angle of 90° in the region from the point P1 to the point Q1. But the shaft of the example 4 was different from that of the example 1 in that the ninth-layer prepreg produced by Graphite Fiber Co., Ltd. had a modulus of elasticity in tension of 44.5 t/mm and a thickness of 0.0227 mm. The prepreg had a reference number: "P6053S-3" (carbon fiber reference number: "M46S").

Example 5

The shaft of the example 5 was the same as that of the example 1 in that the ninth-layer prepreg from the innermost layer was composed of the partial reinforcing hoop layer C3 having a fiber orientation angle of 90° in the region from the point P1 to the point Q1. But the shaft of the example 5 was different from that of the example 1 in that the ninth-layer prepreg produced by Graphite Fiber Co., Ltd. had a modulus of elasticity in tension of 73.5 t/mm and a thickness of 0.11 mm. The prepreg had a reference number of "NU71500-525S" (carbon fiber reference number: "YSH-70").

Example 6

The shaft of the example 6 was the same as that of the example 1 in that the ninth-layer prepreg from the innermost layer was composed of the partial reinforcing hoop layer C3 having a fiber orientation angle of 90° in the region from the point P1 to the point Q1. But the shaft of the example 6 was different from that of the example 1 in that the ninth-layer prepreg produced by Mitsubishi Rayon Co., Ltd. had a modulus of elasticity in tension of 30 t/mm and a thickness of 0.058 mm. The prepreg had a reference number of "MR350J-050S" (carbon fiber reference number: "MR-40").

Comparison Example 1

Figure 5:
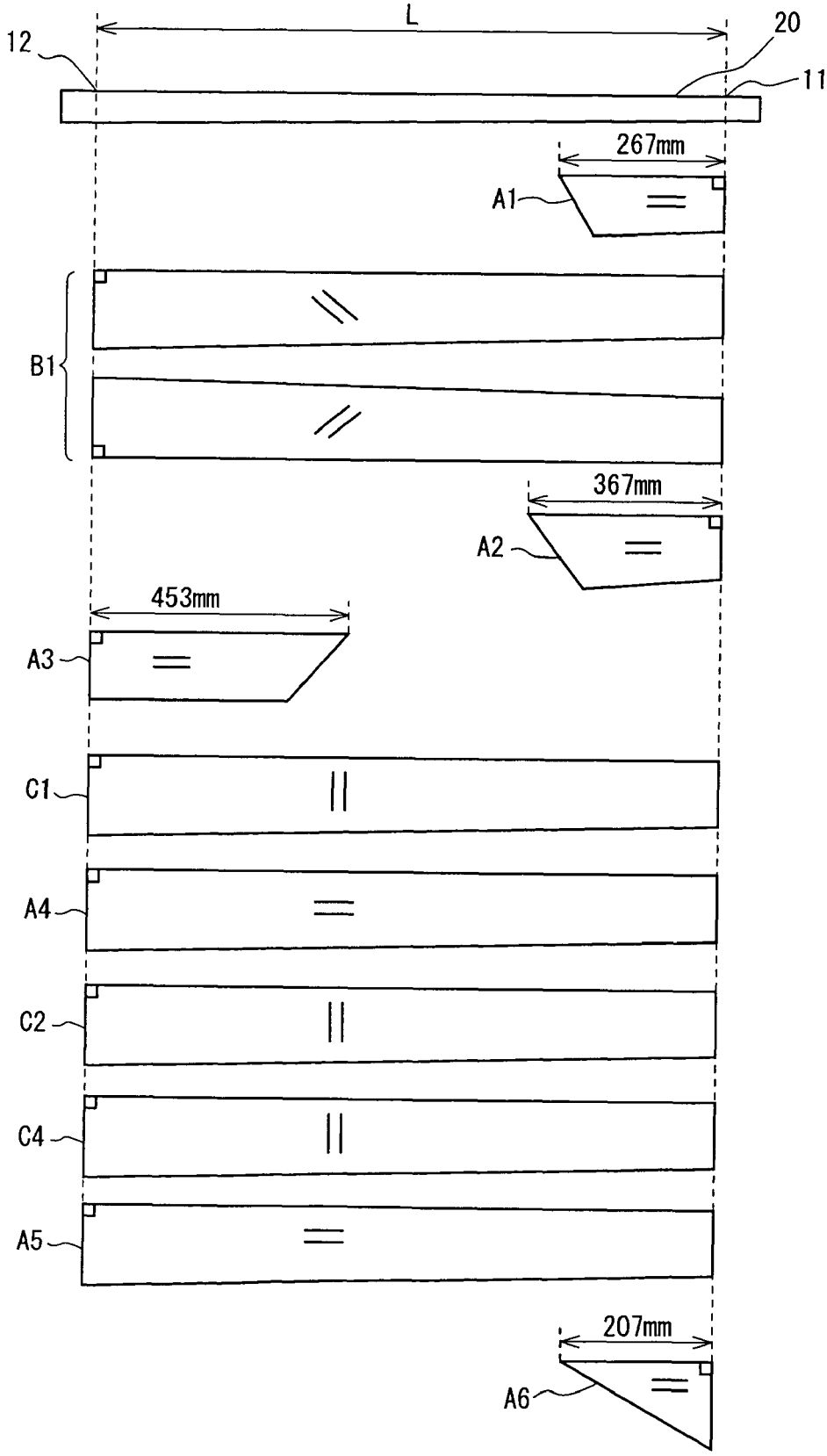
FIG. 5 shows a layered construction of fiber reinforced prepregs of a golf club shaft of a first comparison example.

As shown in FIG. 5, the ninth-layer prepreg from the innermost layer was composed of a prepreg having a fiber orientation angle of 90° disposed over the full length of the shaft to form a full-length hoop layer C4. Other constructions were the same as those of the shaft of the example 1.

Comparison Example 2

Figure 6:
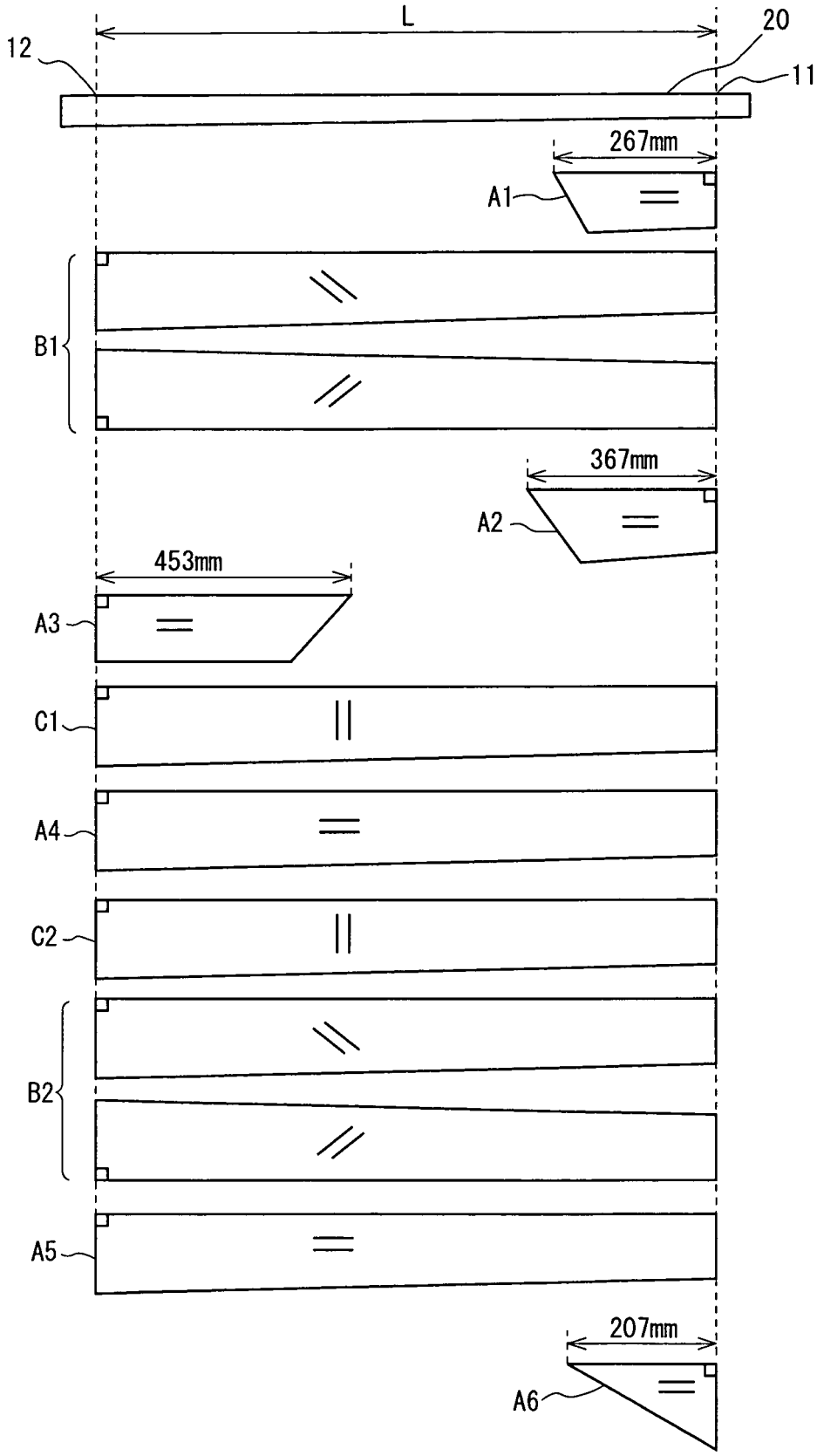
FIG. 6 shows a layered construction of fiber reinforced prepregs of a golf club shaft of a second comparison example.

As shown in FIG. 6, the shaft of the comparison example 2 was the same as that of the example 1 except that a full-length bias set layer B2 was formed between the full-length hoop layer C2 forming the eighth layer of the shaft of the example 1 and the full-length straight layer AS forming the tenth layer of the example 1 by layering two prepregs having fibrous angles of ±45° one upon another and bonding them to each other with the fibrous angles intersecting with each other. The prepreg forming the full-length bias set layer B2 was composed of a product having a modulus of elasticity in tension of 73.5 t/mm$^2$ and a thickness of 0.04 mm was used. The prepreg produced by Graphite Fiber Co., Ltd. had a reference number of "E7026A-03S" (carbon fiber reference number: "YSH-70"). Other constructions of the shaft of the comparison example 2 were identical to that of the shaft of the example 1.

Comparison Example 3

Figure 7:
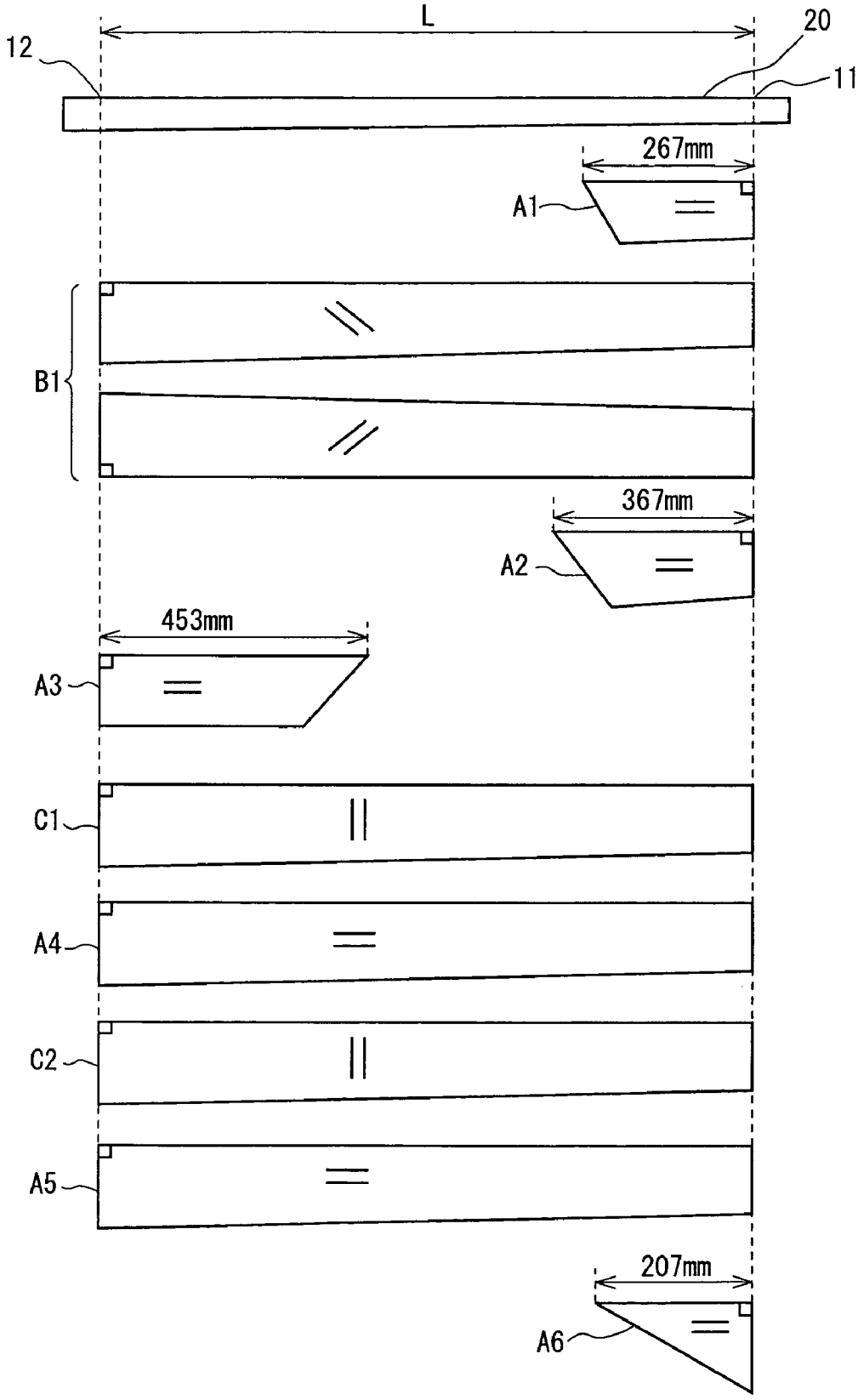
FIG. 7 shows a layered construction of fiber reinforced prepregs of a golf club shaft of a third comparison example.

As shown in FIG. 7, no prepreg was interposed between the eighth layer of the first example consisting of the full-length hoop layer C2 and the tenth layer consisting of the full-length straight layer AS.

Comparison Example 4

Figure 8:
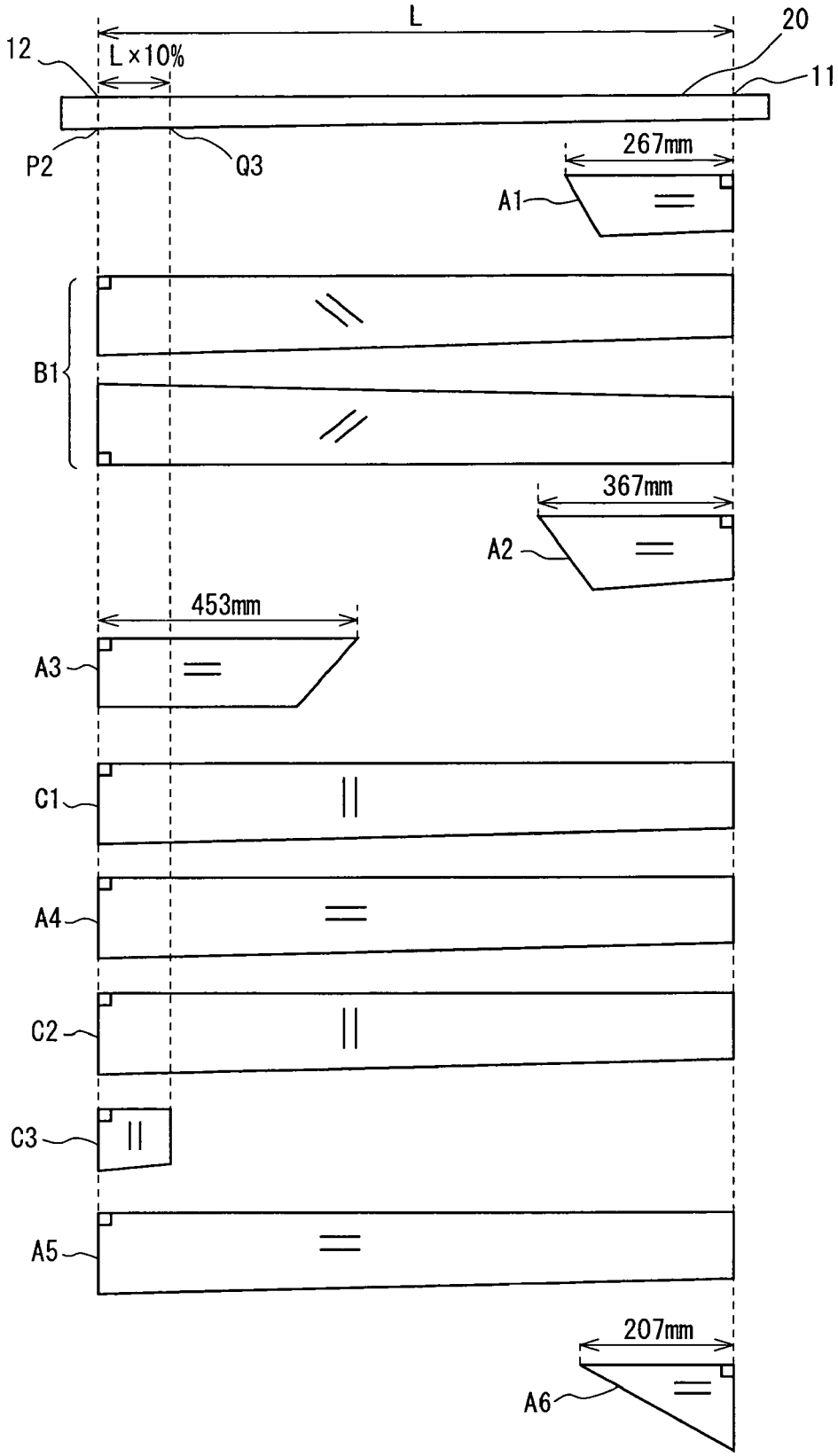
FIG. 8 shows a layered construction of fiber reinforced prepregs of a golf club shaft of a fourth comparison example.

As shown in FIG. 8, the partial reinforcing hoop layer C3 was disposed at the grip-side butt of the shaft. That is, the partial reinforcing hoop layer C3 was disposed in a region from a point P2 spaced at 0% of the full length L of the shaft 10 from the grip-side butt 12 thereof to a point Q3 spaced at 10% of the full length L of the shaft 10 from the grip-side butt 12 thereof. Other constructions re identical to that of the example 1.

Comparison Example 5

Figure 9:
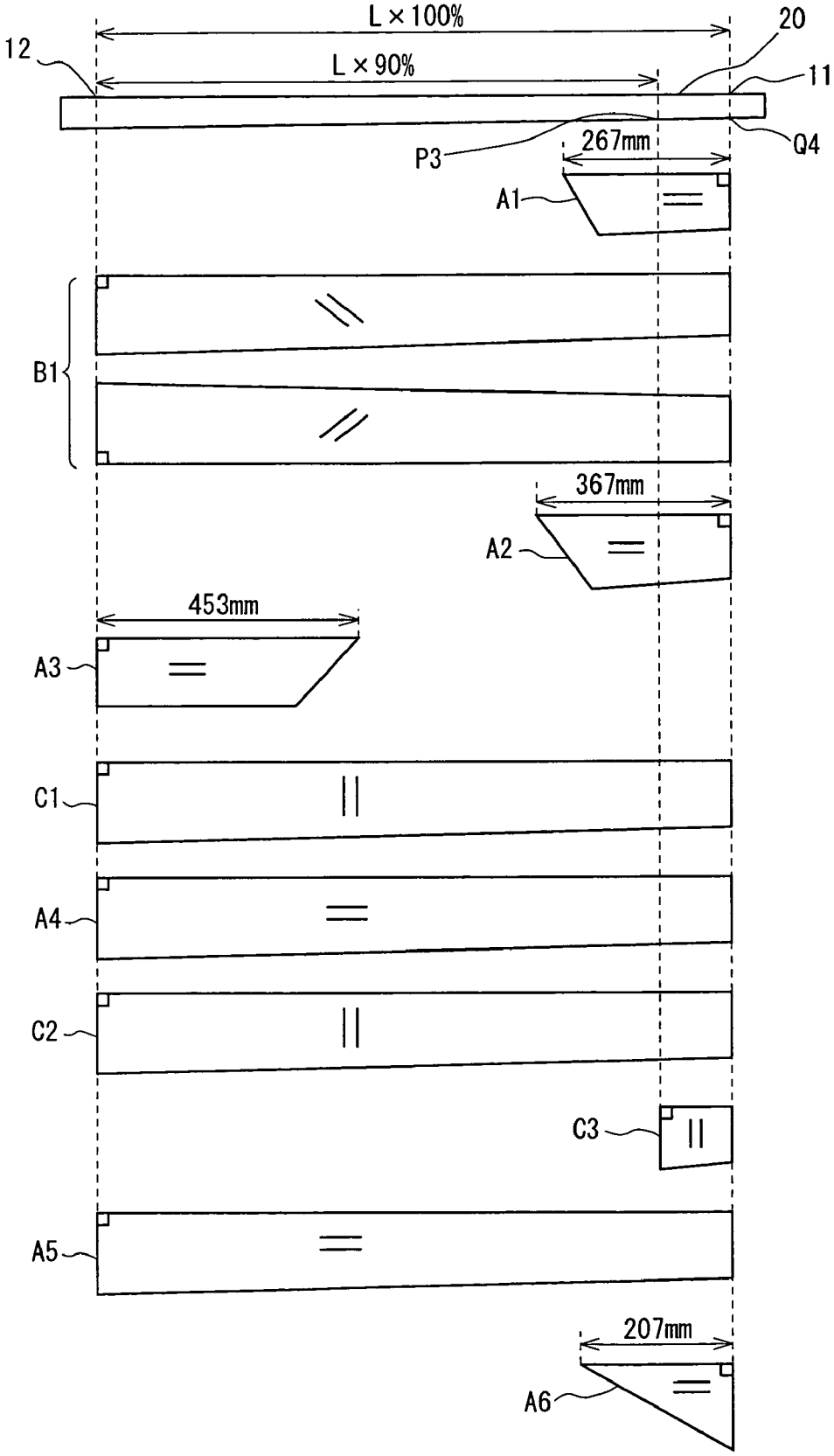
FIG. 9 shows a layered construction of fiber reinforced prepregs of a golf club shaft of a fifth comparison example.

As shown in FIG. 9, the partial reinforcing hoop layer C3 was disposed at the grip-side butt. More specifically, the partial reinforcing hoop layer C3 was disposed in a region from a point P3 spaced at 90% of the full length L of the shaft 10 from the grip-side butt 12 thereof to a point Q4 spaced at 100% of the full length L of the shaft 10 from the grip-side butt 12 thereof. Other constructions were identical to that of the example 1.

The same head was mounted on the shafts of the examples 1 through 6 and the comparison examples 1 through 5. More specifically, a ferrule and a grip were mounted on an XXIO driver (loft angle: 11, model adapted to SLE) produced by SRI Sports Co., Ltd. Golf balls were hit by using each of the shafts to measure head speeds thereof and flight distance of balls hit thereby. Table 1 shows the results.

In a ball-hitting test, 20 players having a handicap of not less than 20 nor more than 35 were requested to hit 10 golf balls consisting of 3-piece ball ("HI-BRID evrio" produced by SRI Sports Co., Ltd.) with each of the shafts.

Method of Measuring Head Speed

The head speed (H/S) was measured by measuring the position of the head at 1000 μs and 3000 μs immediately before a ball impact time.

Method of Measuring Flight distance

Each shortest distance from a straight line connecting a target and a ball-hit point to each other to a ball-stopped position was measured. Table 1 shows the average of measured shortest distances of balls hit by 20 players.

As can be confirmed from table 1, the shafts of the examples 1 through 6 had higher head speeds and hit longer flight distances than those of the comparison examples 1 through 5. This is because by disposing the hoop layers of the shafts of the examples 1 through 6 in only the important reinforcing region X, the sectional deformation of the important reinforcing region X was restrained at the time of swings, and the shafts of the examples 1 through 6 returned to the original state more quickly than those of the comparison examples 1 through 5 from the state thereof in which they flexed at a swing time.

In the shaft of the comparison example 1, because the ninth-layer prepreg was composed of the full-length hoop layer C4, the shaft did not hit balls a long distance and was low in the head speed thereof. Because the full-length hoop layer composing the ninth layer was disposed beyond the important reinforcing region X, a proper degree of flexure of the shaft necessary for increasing the flight distance was restrained.

In the shaft of the comparison example 2, the ninth-layer prepreg was composed of the full-length bias set layer B2. Comparing the result of the comparison example 2 with those of the examples 1 through 6, it has been found that the hoop layer is more effective than the bias layer in returning the shaft to its original state.

In the comparison examples 4 and 5, the hoop layer composing the ninth layer was disposed beyond the important reinforcing region X. Comparing the results of the shafts of the comparison examples 4 and 5 with those of the examples 1 and 3, it has been found that to dispose the hoop layer in the important reinforcing region X is effective for quickly returning the shaft to its original state.

Comparing the shafts of the examples 1 through 4 and 6 with one another, it has been found that to increase the fiber modulus of elasticity in tension of the thickness of the ninth layer composed of the hoop layer is effective for improving the flight distance and the head speed.

Comparing the results of the shafts of the examples 1 and 5 with each other, it has been found that to increase the thickness of the ninth layer composed of the hoop layer decreases the effect of improving the flight distance and the head speed.

What is claimed is:

1. A golf club shaft having a weight not less than 30 g nor more than 60 g;

said golf club shaft comprising a bias layer composed of a prepreg whose reinforcing fibers have an orientation angle of not less than ±10° nor more than 80° to an axis of said golf club shaft; and a plurality of straight layers each composed of a prepreg whose reinforcing fibers have an orientation angle within 0°±10° to said axis of said golf club shaft, wherein at least one partial reinforcing hoop layer whose reinforcing fibers have an orientation angle of within 90°±10° to said axis of said golf club shaft is disposed in only an important reinforcing region in a range from a point P spaced at 15% of a full length of said golf club shaft from a grip-side butt thereof to a point Q spaced at 45% of said full length of said golf club shaft from said grip-side butt thereof.

2. A golf club shaft having a weight not less than 30 g nor more than 60 g;

said golf club shaft comprising a bias layer composed of a prepreg whose reinforcing fibers have an orientation angle of not less than ±10° nor more than 80° to an axis of said golf club shaft; and a plurality of straight layers each composed of a prepreg whose reinforcing fibers have an orientation angle within 0°±10° to said axis of said golf club shaft, wherein at least one partial reinforcing hoop layer whose reinforcing fibers have an orientation angle of within 90°±10° to said axis of said golf club shaft is disposed in only an important reinforcing region in a range from a point P spaced at 15% of a full length of said golf club shaft from a grip-side butt thereof to a point Q spaced at 45% of said full length of said golf club shaft from said grip-side butt thereof, and wherein said bias layer, one of said plurality of straight layers, and a full-length hoop layer are disposed over a full length of said golf club shaft; and said full-length straight layer is disposed as an outermost full-length layer; and said partial reinforcing hoop layer is disposed adjacently to said full-length straight layer with said partial reinforcing hoop layer disposed inward from an inner periphery of said full-length straight layer.

* * * * *